United States Patent [19]

Engel

[11] Patent Number: 4,988,145

[45] Date of Patent: Jan. 29, 1991

[54] SEATING FURNITURE

[75] Inventor: Hartmut S. Engel, Freiberg am Necker, Fed. Rep. of Germany

[73] Assignee: Roeder GmbH Sitzmoebelwerke, Frankfurt, Fed. Rep. of Germany

[21] Appl. No.: 363,346

[22] Filed: Jun. 6, 1989

Related U.S. Application Data

[63] Continuation of Ser. No. 57,589, Jun. 2, 1987, abandoned.

[30] Foreign Application Priority Data

Jun. 4, 1986 [DE] Fed. Rep. of Germany ..... 3618705
Sep. 22, 1986 [DE] Fed. Rep. of Germany ..... 3632131
Feb. 10, 1987 [DE] Fed. Rep. of Germany ..... 3704083

[51] Int. Cl.[5] ..... A47C 1/32

[52] U.S. Cl. ..... 297/301; 297/302; 297/321; 297/322; 297/286

[58] Field of Search ..... 297/300, 301, 302, 304, 297/305, 317, 320–323, 342, 420, 421, 286

[56] References Cited

U.S. PATENT DOCUMENTS

| | | | |
|---|---|---|---|
| 2,492,103 | 12/1949 | Merrill | 297/342 X |
| 2,492,106 | 12/1949 | Orbon | 297/322 X |
| 2,509,739 | 5/1950 | McDonald | 297/342 X |
| 2,796,918 | 6/1957 | Luckhardt | 297/321 |
| 3,139,305 | 6/1964 | Mizelle | 297/317 |
| 4,411,469 | 10/1983 | Drabert et al. | 297/322 X |

*Primary Examiner*—Peter R. Brown
*Attorney, Agent, or Firm*—Townsend and Townsend

[57] ABSTRACT

A functional chair is described the backrest of which can be pivoted relative to the seat and in which the seat can also be lowered in the region of the front edge. For this purpose at least one lowering lever is provided which is mounted on the one hand relative to the seat and on the other hand relative to a fixed axle of the frame and which is adjustably connected, via a transmission for movement in the opposite direction, to a link which is connected with the backrest and is likewise pivotally mounted on a fixed axle of the frame.

34 Claims, 15 Drawing Sheets

Figure 1:
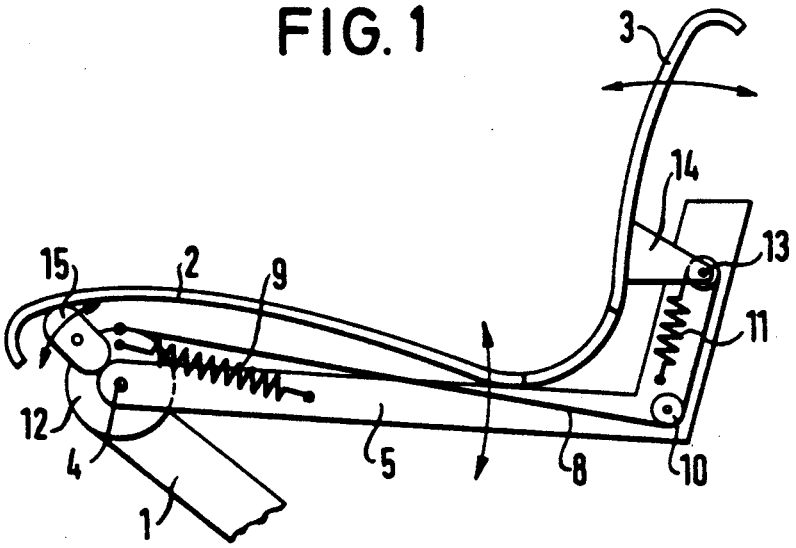

FIG. 4
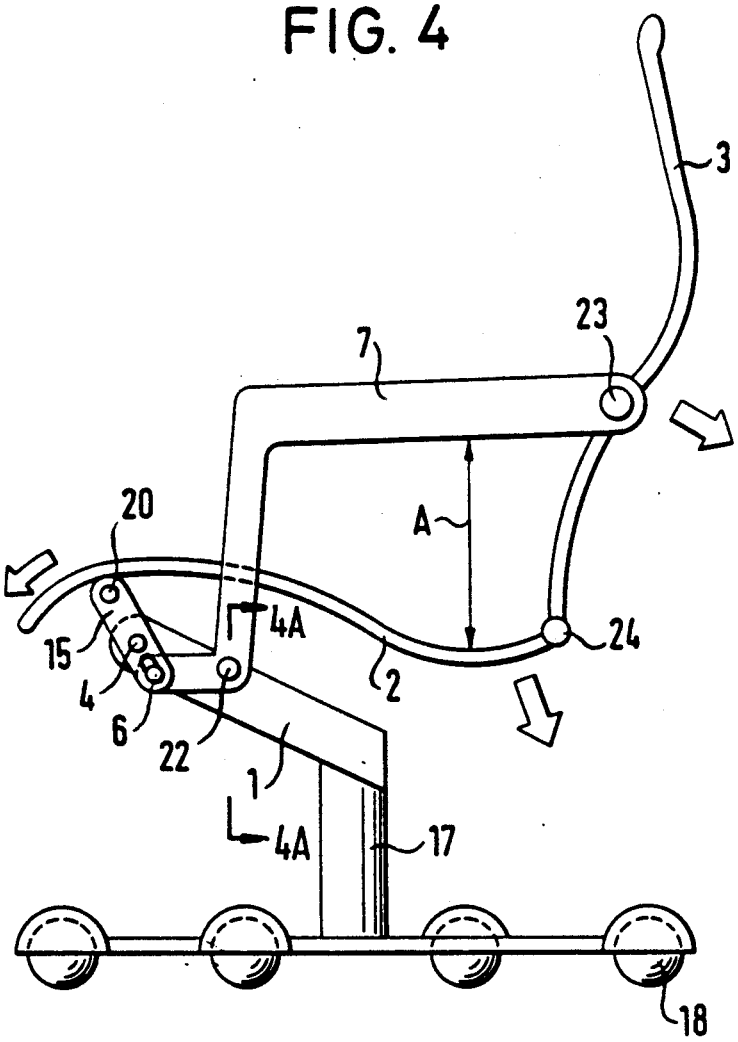
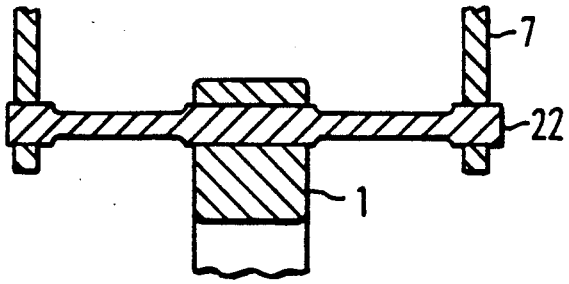
FIG. 4A

SEATING FURNITURE

This is a continuation of application Ser. No. 07/057,589, filed June 2, 1987, now abandoned.

The invention relates to functional seating furniture, in particular for office use, comprising a frame, a seat pivotable about a horizontal frame axis against the force of a spring and of adjustable inclination, and also a backrest pivotable in dependence on the respective inclination of the seat.

It is to be required of seating furniture of this kind that it ensures the user has a balanced body position in order to relieve the muscular system, to reduce the pressure on the discs of the spine and to avoid congestion in the legs and pelvic region. A working chair of this kind must also simultaneously assist the activity of the particular person using it, i.e. promote active deportment, that is to say to ensure that the body adopts physiologically favourable positions.

A precondition for this is the possibility of permitting a continuous change of the seating position in order to make it possible in this way for the user to sit for long periods of time without trouble occurring in the muscular system and in the joints. The realisation of all these requirements in functional seating furniture may not be permitted to lead to excessive technical cost and complexity.

It is the principle object underlying the invention to provide functional seating furniture of the initially named kind which, on the one hand, ensures adjustment of the inclination of the seat and of the backrest, with these inclinations being combined in ideal manner, and which, on the other hand, realizes the movements of the seat and backrest by means of an extremely compact support and adjusting mechanism which can be manufactured in a particularly economical manner.

This object is satisfied substantially in that the front part of the seat is braced, in particular in the side region, in each case against one arm of a two-armed lever pivotably mounted on the frame, the other arm of which engages in each case with a link which is pivoted in accordance with the seat inclination and which thereby brings about a lowering of front edge of the seat on increasing the inclination of the seat.

As a result of this layout one obtains an ideal characteristic for the relative movements of the seat and backrest in dependence on the particular position desired by the user, with the enlargement of the angle between the seat and the backrest being associated with a lowering of the front edge of the seat. This is achieved using the simplest kinematic elements which, in accordance of a particularly advantageous layout of the invention are disposed to the sides of the seat and backrest. As a result of the pivotal attachment of the front edge of the seat to the two-armed lever the seat moves somewhat forwardly during this lowering movement and this forward movement of the seat is exploited to change or to increase the included angle between the seat and the backrest.

If, in accordance with a preferred embodiment of the invention, the lever arm of a further two-armed lever connected with the backrest is formed as an armrest carrier, then one also obtains the desired increase in the distance between seat and armrest in the relaxation position.

The mentioned use of a second two-armed lever as an armrest carrier, or as an armrest is of advantage both from economical, constructional and design aspects, is not however an essential requirement, since the arm of this two-armed pivot lever which extends between the pivot axis fixed to the frame and the pivot joint at the backrest is not subject to any particular constraints with regard to its shape and layout, but must only be rigid.

A preferred layout of the transmission leads to an extremely compact arrangement and makes it possible to mount the kinematic elements to the side of the seat. This permits a transparent layout of the seat, or is indeed a precondition therefor.

The transmission ratio can be predetermined without problems and the ratio of the inclination of the seat to the inclination of the backrest can for example amount to 1:2 and can readily be modified to 1:3.

When an actuating arrangement in the form of a band tensioned by a tension spring is used then it is possible to achieve a particularly favourable and space saving adaption to three dimensional constraints and to achieve a particularly economical construction. The transmission unit can be constructed as a compact unit which contains all the elements relevant to the movement, can follow the shape of the seat and backrest in angled manner, and can simultaneously be used as the armrest.

If the lowering lever which is pivotally connected in the region of the front edge of the seat is displaced via a transmission in the opposite sense to the link which is connected to the backrest, and which is likewise pivotally mounted on the fixed axle of the frame, then the fixed axle of the frame preferably consists of a guide tube in which a torsion bar is arranged, in particular a torsion bar which is fixed at its middle, the ends of the torsion bar being connected in form-locked and force transmitting manner to the links which extend to the backrest and are pivotally mounted on the guide tube ends.

As a result of this coaxial construction of all carrier and positioning elements necessary to the operation of the chair, one obtains an extremely compact arrangement which brings advantages both from the point of view of manufacture and assembly, and which achieves the desired relative pivoting motion between the seat and the backrest in conjunction with simultaneous lowering of the front edge of the seat, despite the simple construction.

A preferred further development of the functional seating furniture of the invention is characterized in that the backrest is subdivided into a base part which is pivotally connected to the second two-armed lever and a support part which is pivotally connected to a carrier lever and is adjustable, between a position corresponding approximately to the inclination of the base part and a position spaced from the base part and displaced towards the front edge of the seat, via a positioning mechanism which pivots the carrier lever.

This embodiment makes it possible to achieve effective support of the lumbar region and of the spinal column when the male or female user of the chair simply sits on the front region of the seat—in particular in the typewriting position—. It is also possible to accommodate the entire positioning mechanism in an extremely space saving manner within the contour lines of the functional elements and in a manner which is in no way disturbing from the point of view of the design.

In these embodiments of the functional seating furniture with a divided backrest one obtains in addition the advantageous effect that each time the user selects the relaxing position the increase of the included angle between the seat and the backrest resulting from the lowering of the front edge of the seat has the consequence that in each case the carrier lever for the backrest support part is moved backwardly, and a pleasing relaxation position is automatically achieved, i.e. without additional switching.

In the described embodiments of the invention vertical adjustment of the backrest can in each case be achieved without problems.

Further special features and advantageous developments of the invention are set forth in the subordinate claims.

Figure 2:
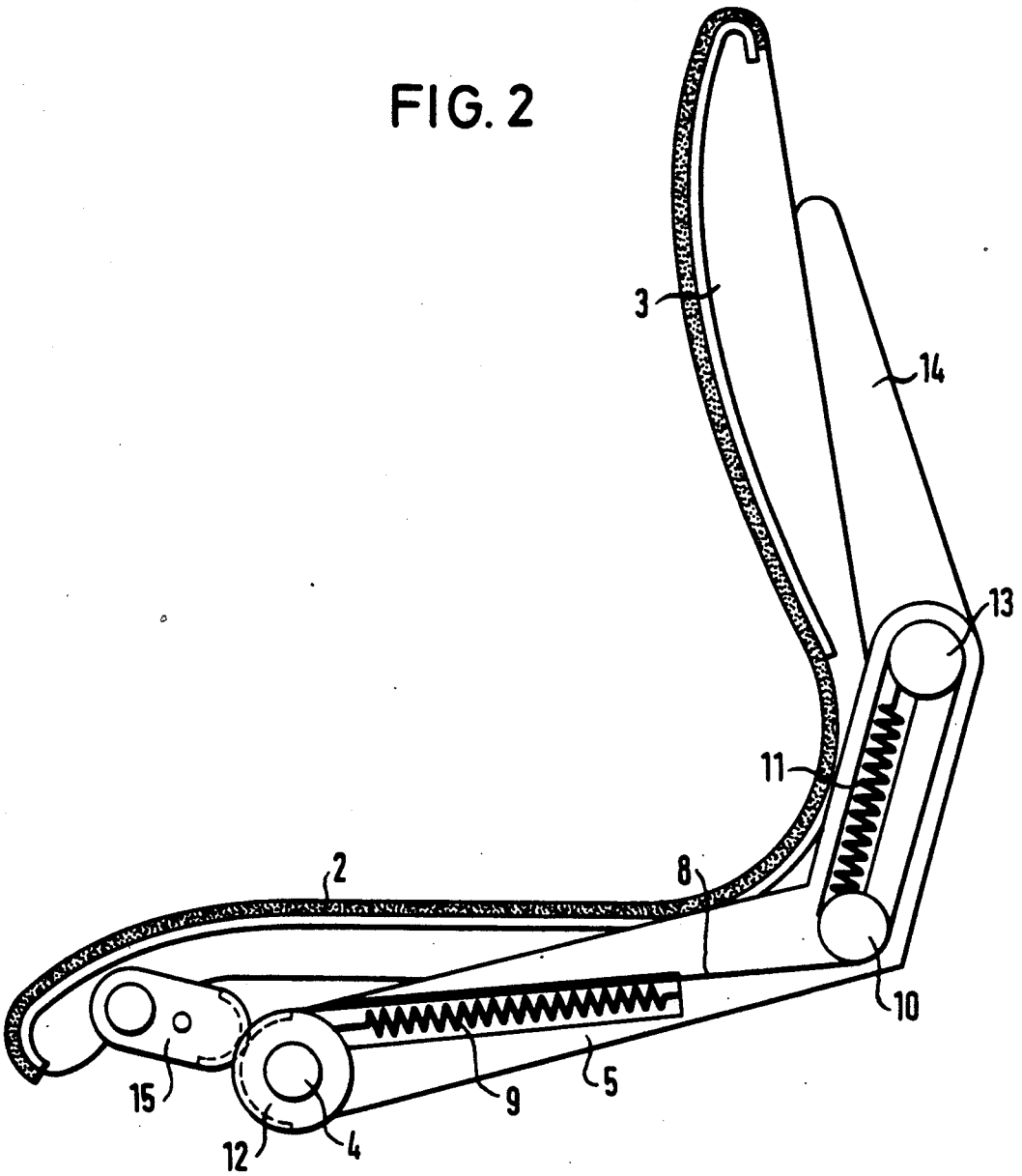
Figure 3:
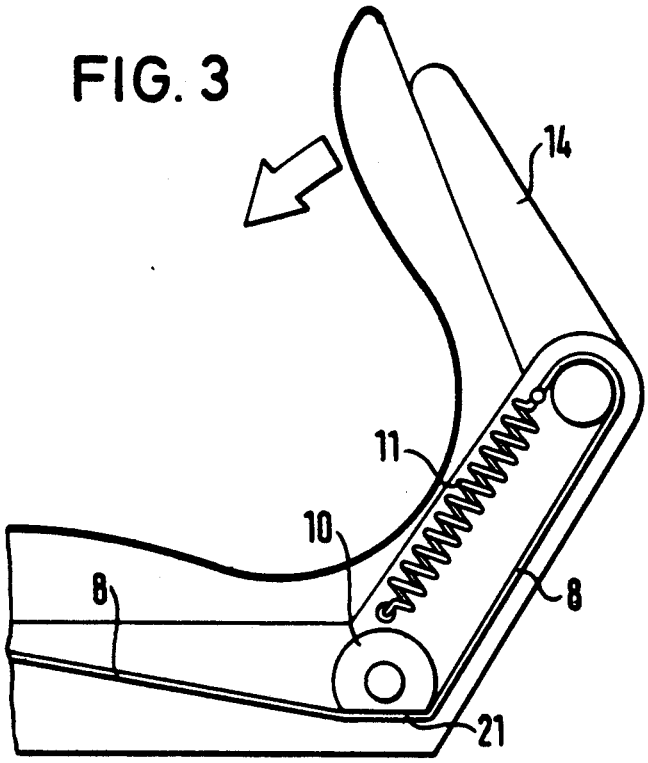

Embodiments of the invention will now be described in the following in more detail with reference to the drawings in which are shown:

FIG. 1 a schematic illustration of principle of a chair in accordance with the invention, FIG. 2 a schematic illustration of an embodiment of the chair of FIG. 1 in a position corresponding to a position of the user in which the user is able to carry out an action, FIG. 3 a schematic representation of a further variant of a chair in a position in which the user can carry out an action, FIG. 4 a schematic representation for the purpose of explaining the operating principle and the basic construction of a further variant of the chair of the invention as shown in the basic position, FIG. 4A a representation corresponding to that of FIG. 4 taken through lines 4A–4A of FIG. 4.

Figure 5:
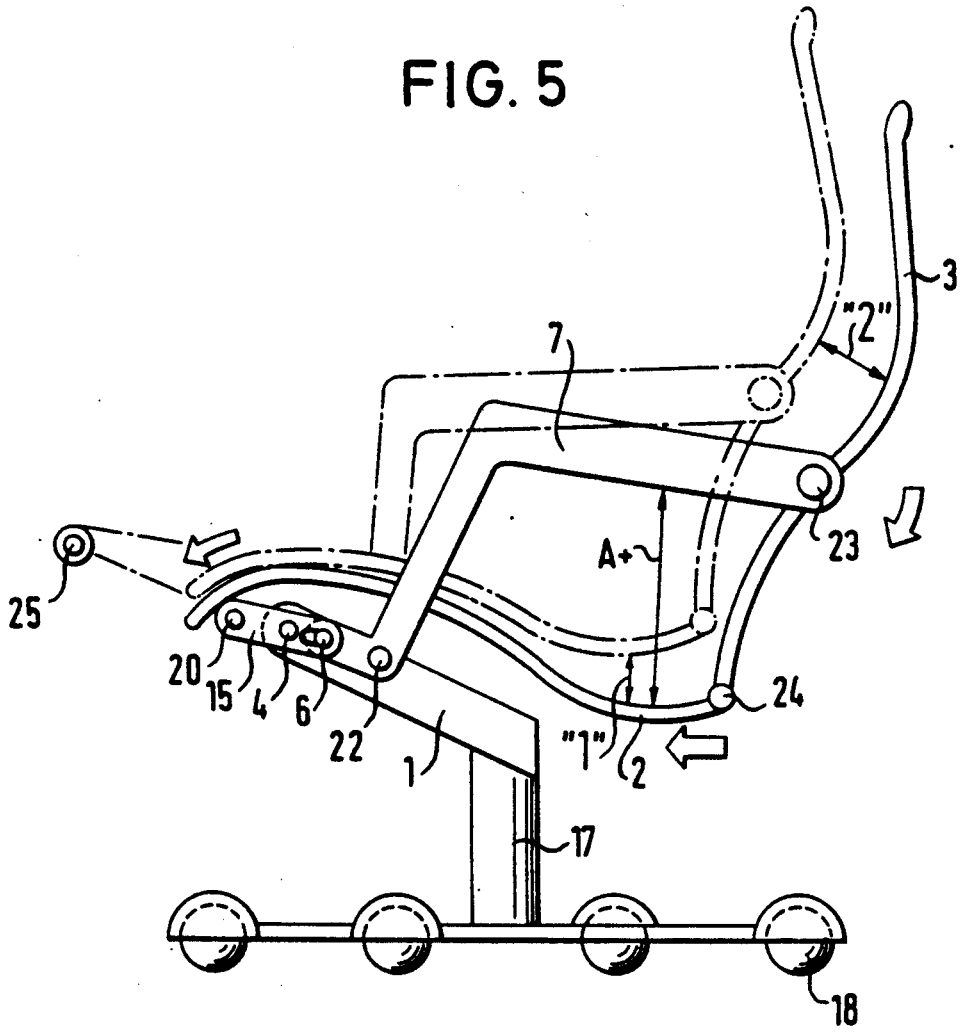
Figure 6:
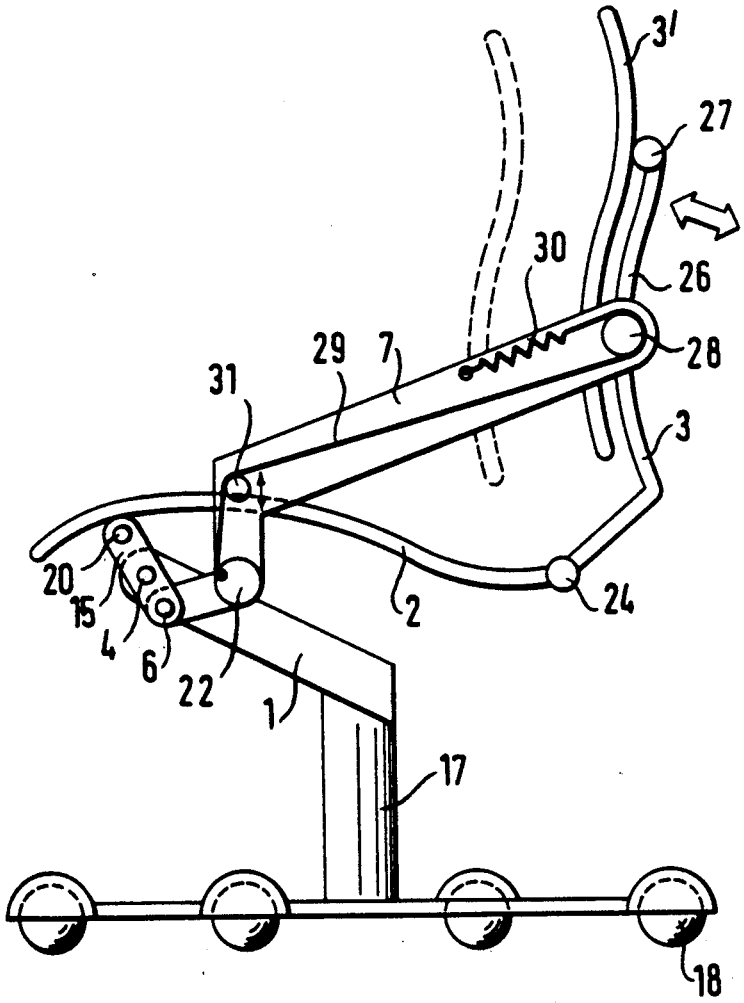
Figure 7:
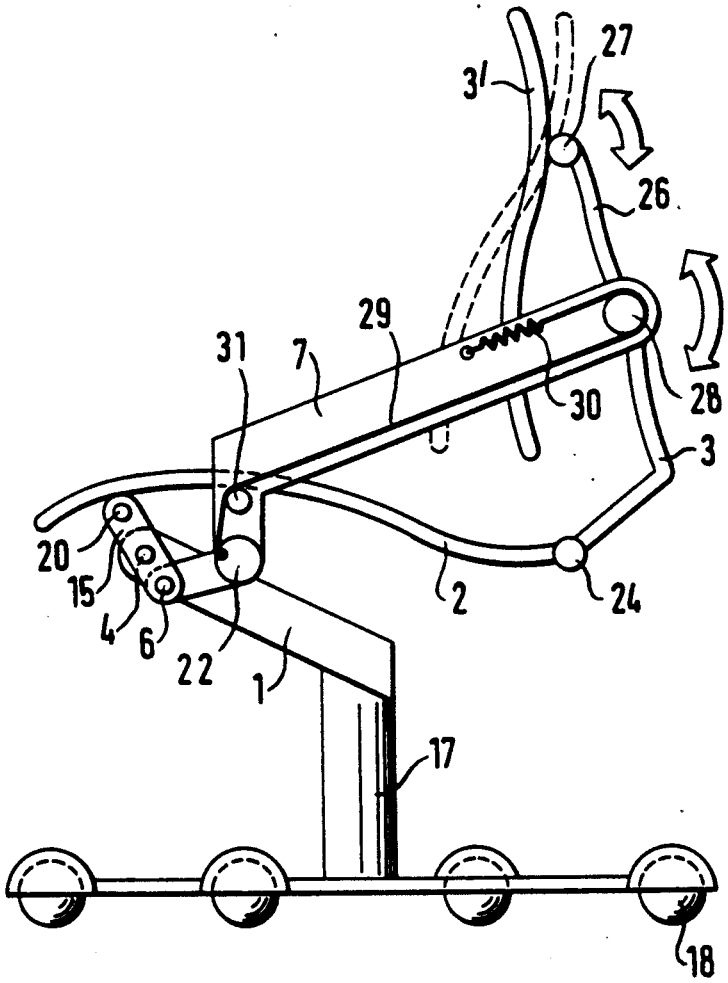
Figure 8:
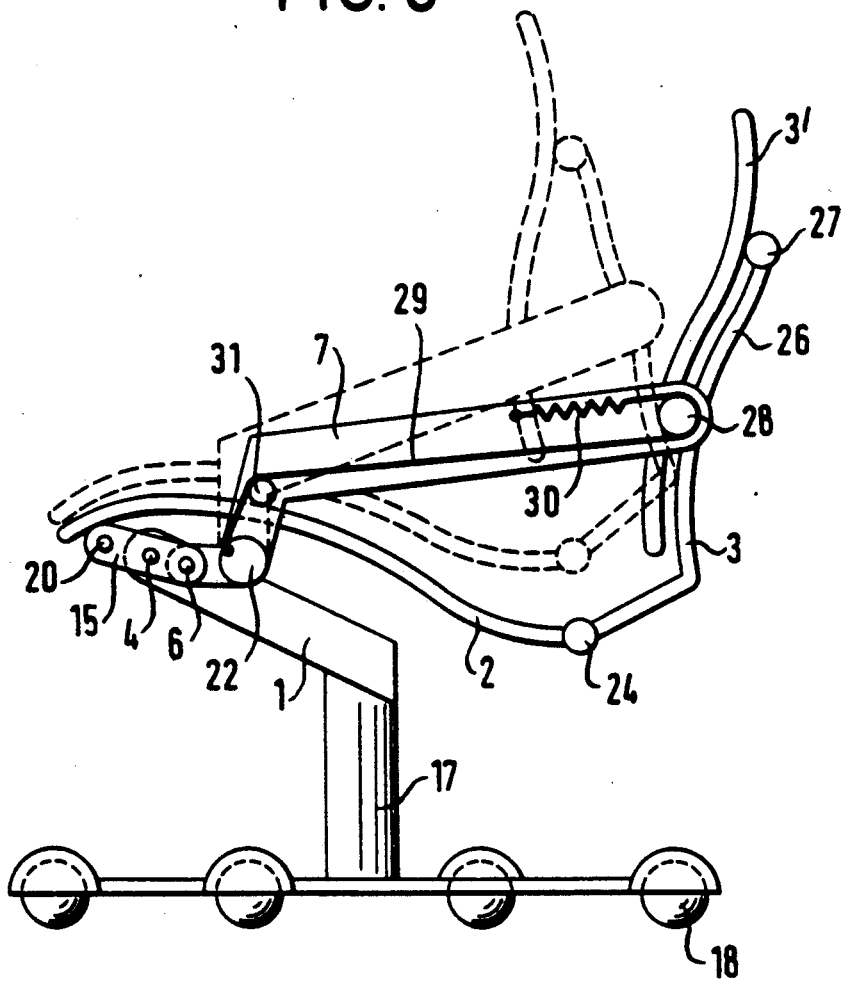
Figure 9:
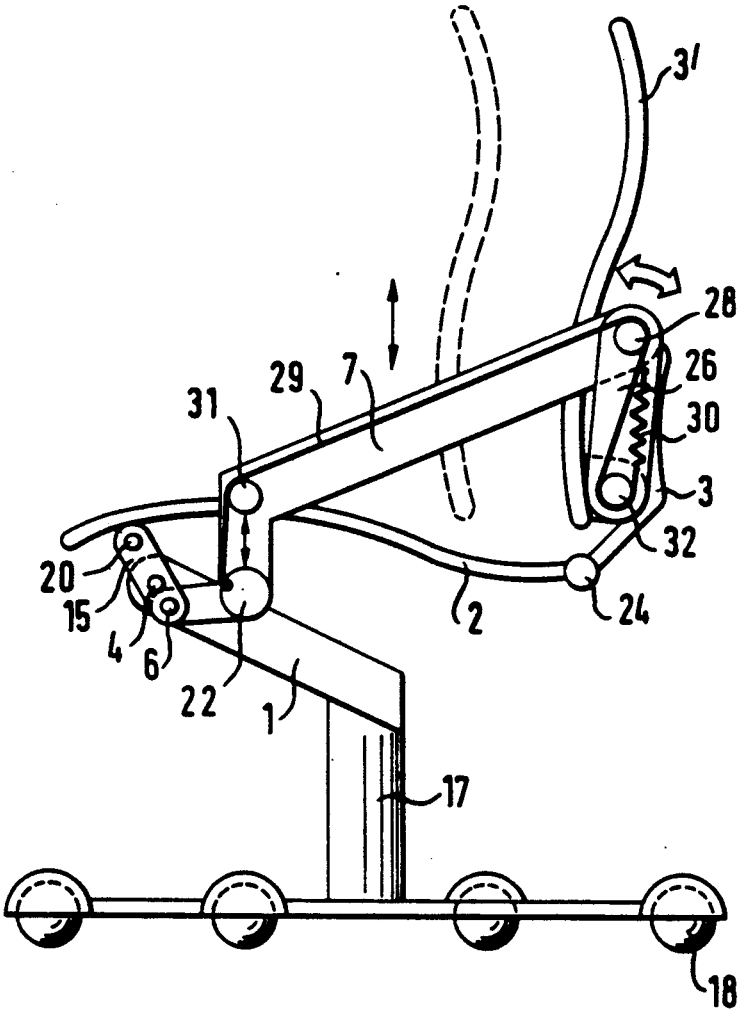
Figure 10:
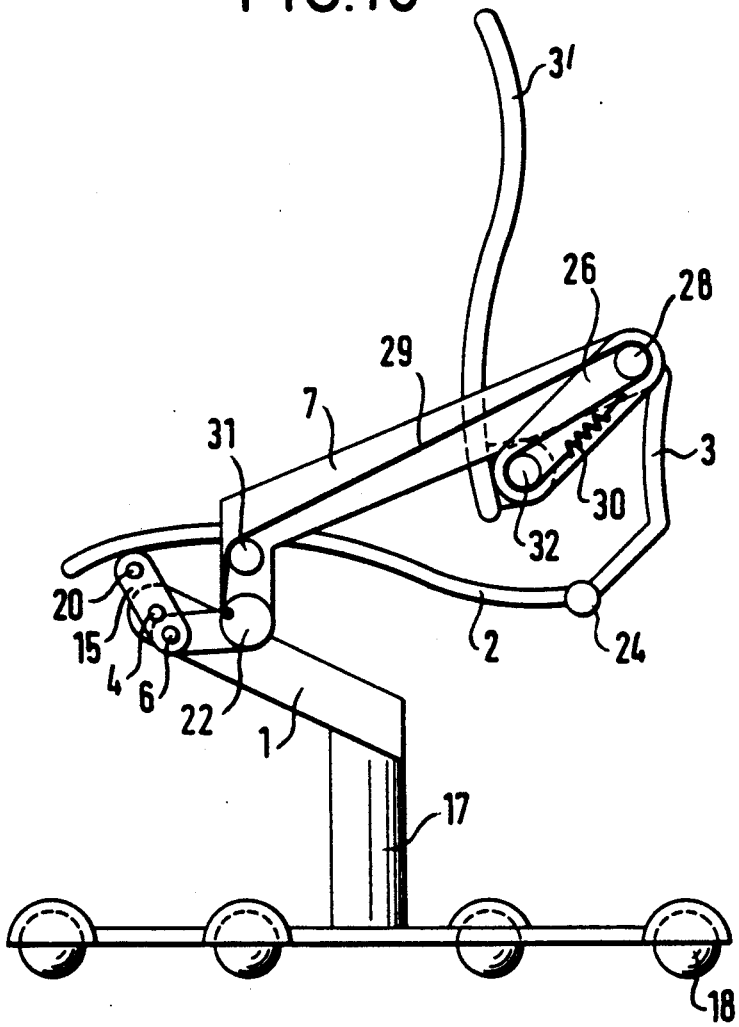
Figure 11:
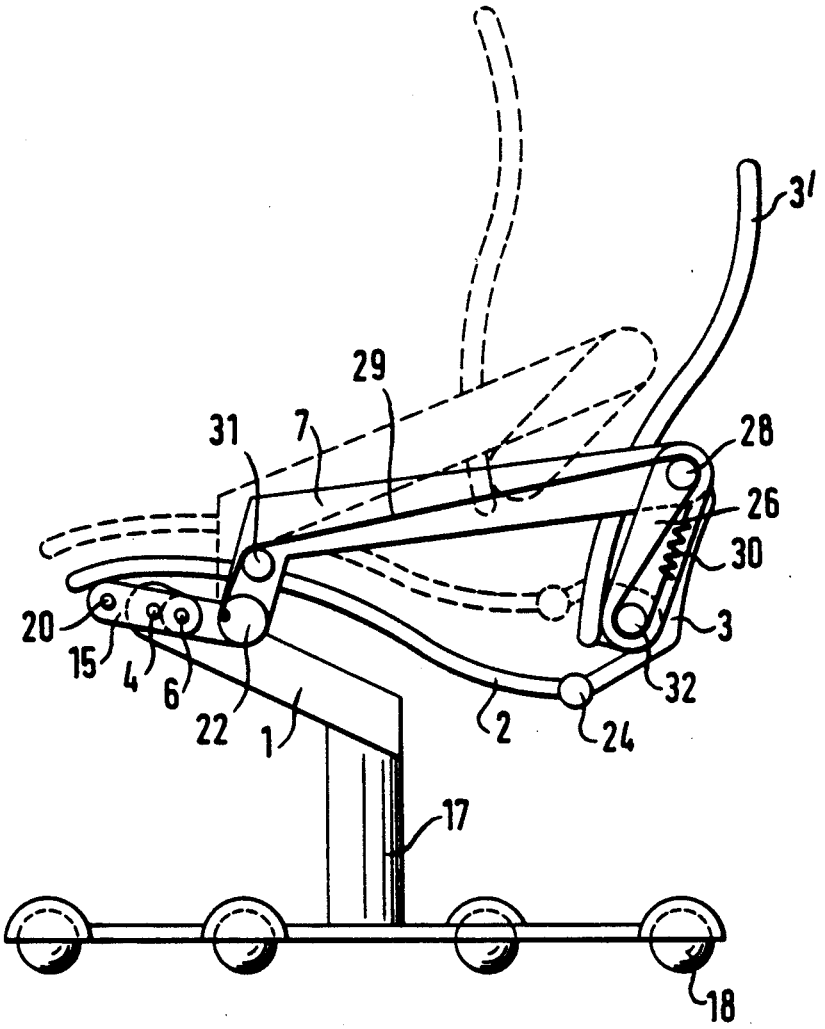
Figure 12:
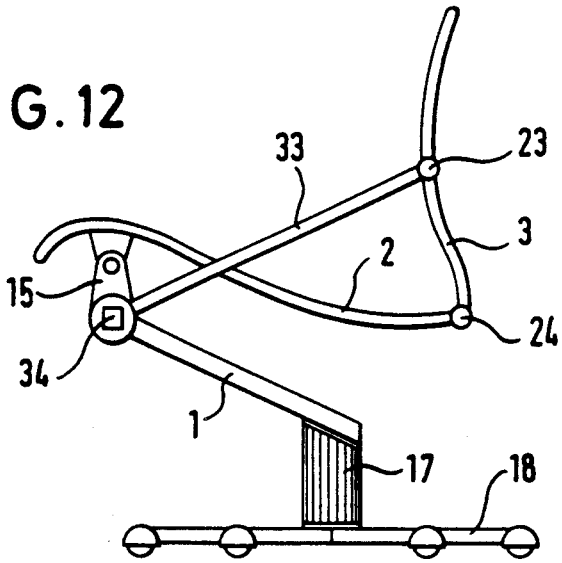
Figure 13:
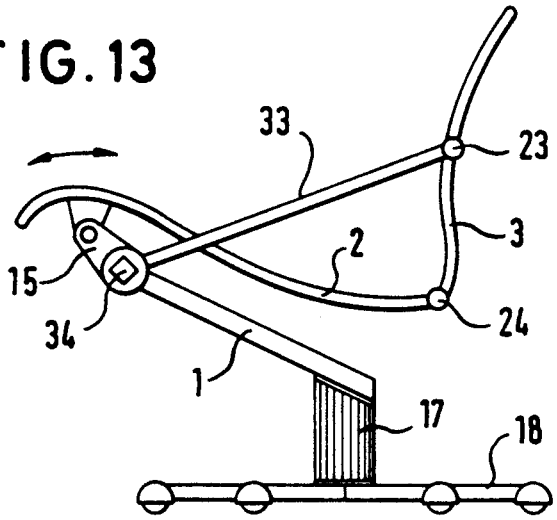
Figure 14:
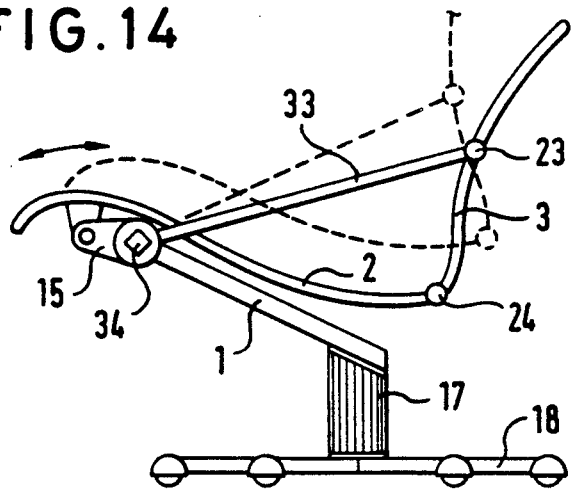
Figure 15:
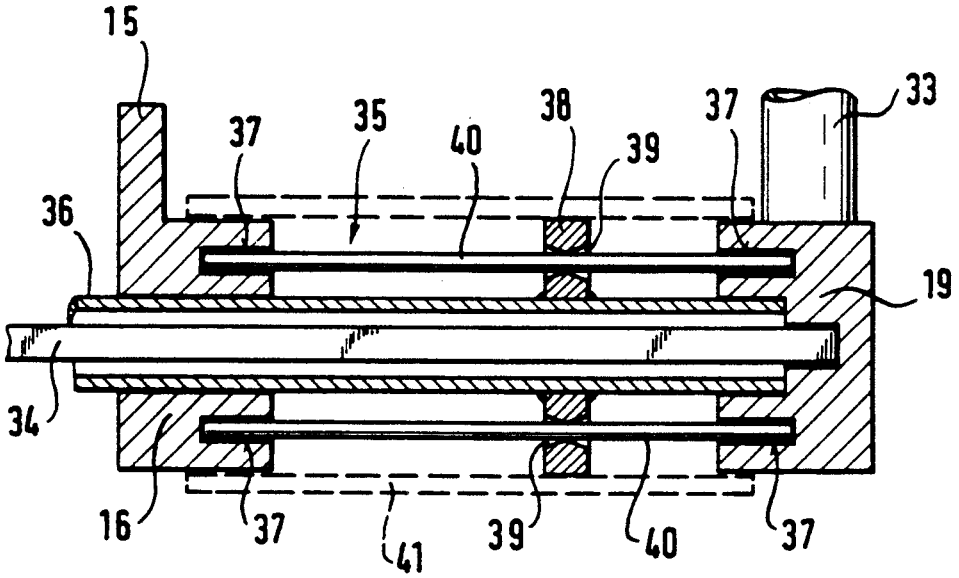
Figure 16:
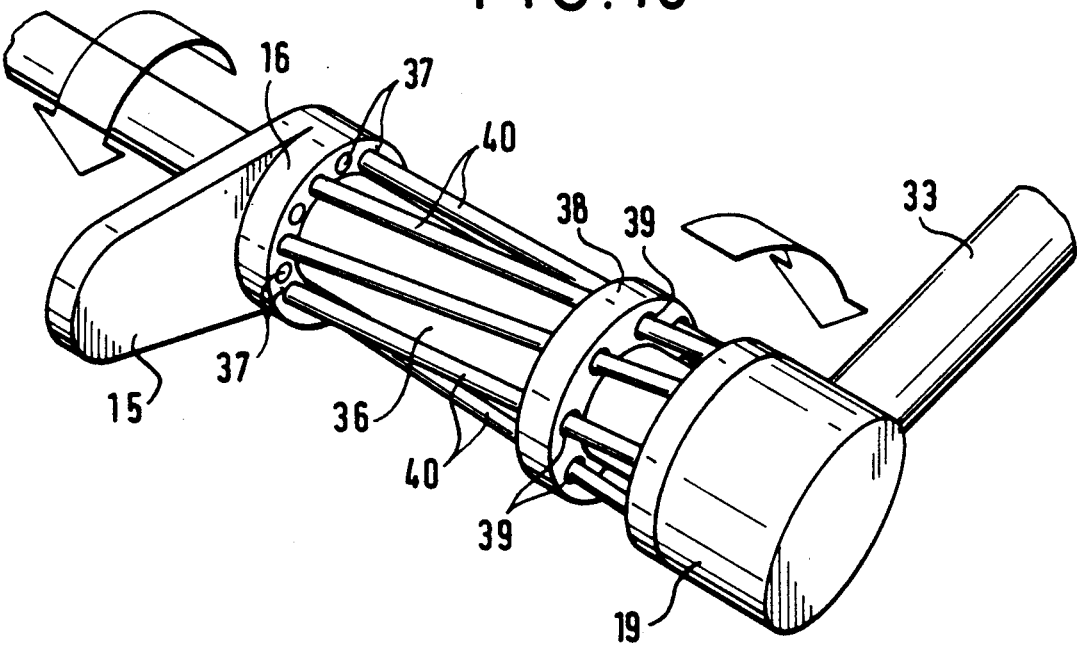
Figure 17:
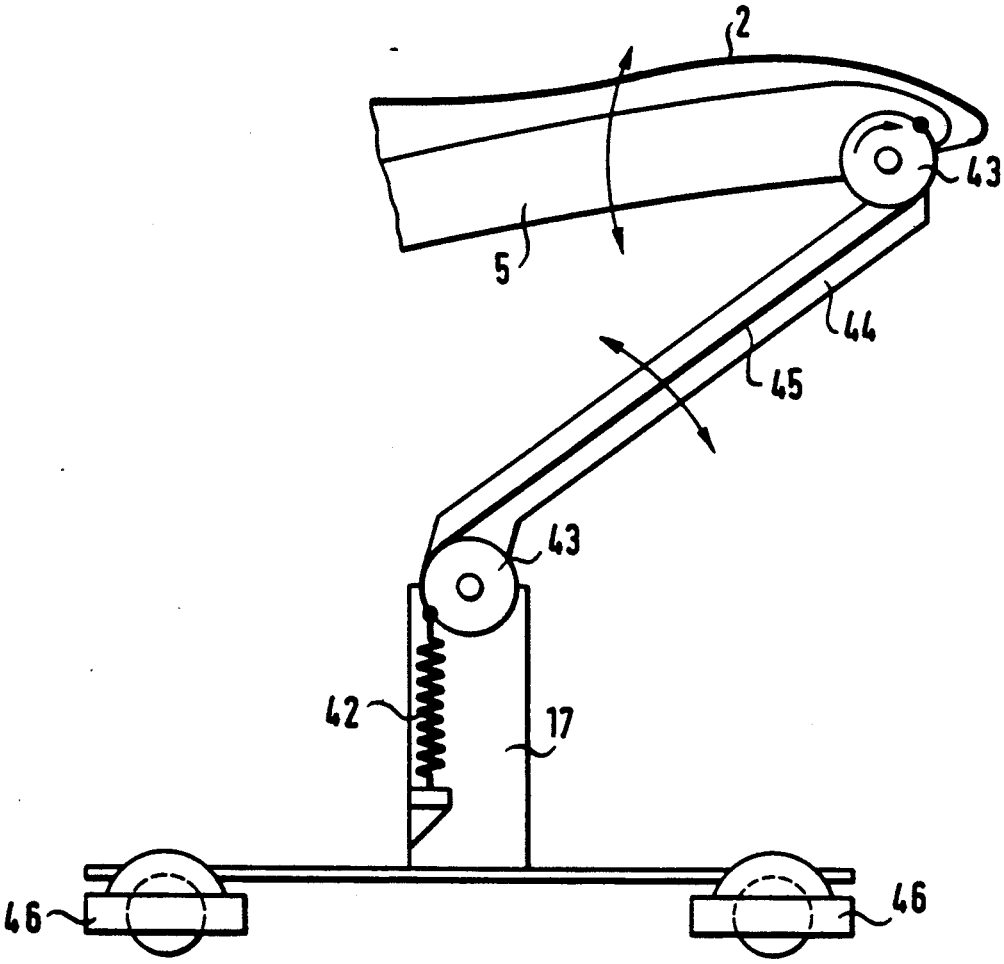
Figure 18:
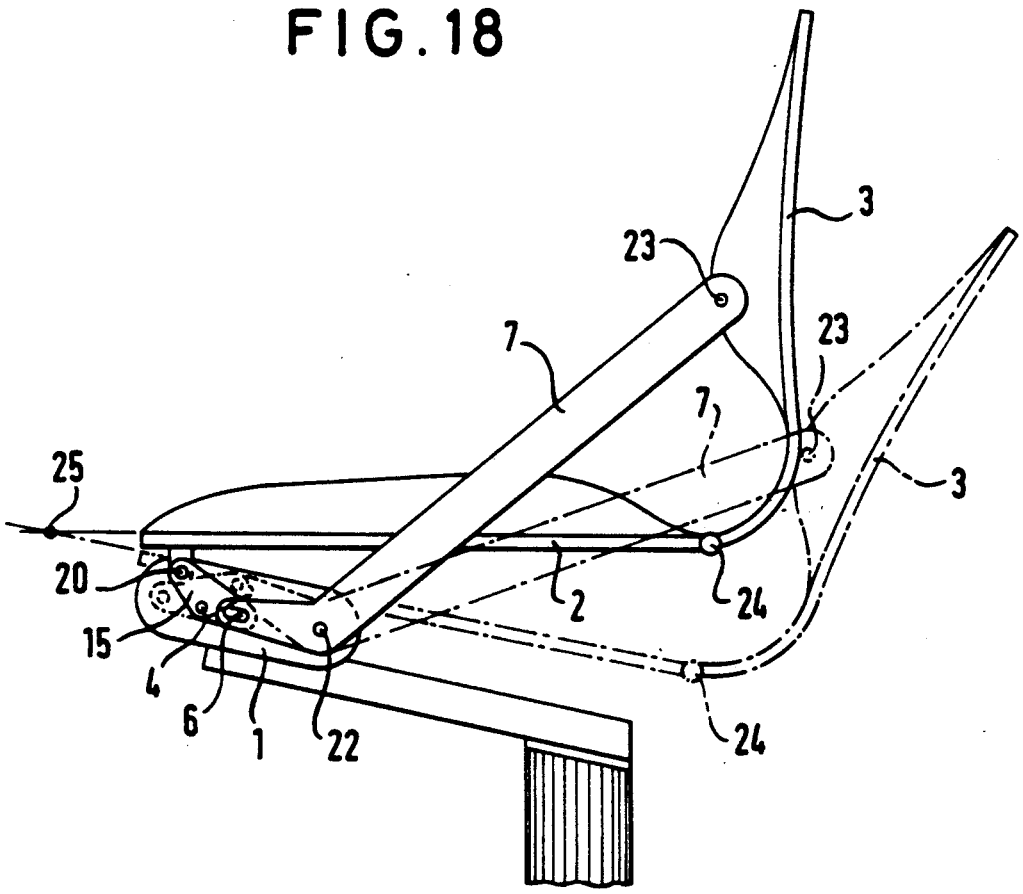

FIG. 5 a representation corresponding to that of FIG. 4 showing the chair in the relaxation position, FIG. 6 a schematic representation of an embodiment with a divided backrest, with the chair being shown in the basic position, FIG. 7 a representation of the chair of FIG. 5 with the seat inclination unchanged but with the backrest displaced towards the front edge of the seat, FIG. 8 representation of the chair of FIGS. 6 and 7 in the relaxation position, FIG. 9 a further embodiment of a chair with a horizontally displaceable backrest as seen in the basic position, FIG. 10 a schematic representation of the chair of FIG. 9 in a position in which the user is active with the backrest displaced towards the front edge of the seat, FIG. 11 a representation of the chair of FIGS. 9 and 10 in the relaxation position, FIGS. 12 to 14 schematic representations of various positions of a further embodiment of the invention, FIG. 15 a schematic part sectional representation to explain the cooperation of the lowering lever, deflection transmission and carrier link, FIG. 16 a perspective representation of the arrangement of FIG. 15 with the lowering lever in its lower position, FIG. 17 a schematic representation to explain a weight depend ant control of the resetting force, and FIG. 18 a schematic representation of a further development of the chair of FIG. 4.

The schematic representation of FIG. 1 shows in schematic manner a part of a frame 1 which can in principle be executed in any desired manner and which carries a seat or seat surface 2 and a backrest 3. Seat 2 and backrest 3 can consist of separate pivotally connected parts but can however also consist of a unitary bucket or shell part which is capable of being opened out. The seat 2 is supported on links 5 or connected with these links 5 which extend on both sides of the seat, with the links being pivotable on a horizontal frame axle 4 and being biased into a basic position by means of spring force.

In the following the function of one of the two links 5 will be described, together with the associated kinematic elements, since the corresponding unit on the opposite side of the seat is made in analog manner, i.e. in mirror image fashion.

In FIG. 1 a resetting spring 9, which serves to reset the seat, is mounted between the frame and a pivot point of the link 5, with the link and the longitudinal axis of the spring subtending an acute angle to one another. This resetting spring 9 however represents in practice an assistor spring for the main resetting spring which is formed by a torsion bar which is held at the center in a tube forming the horizontal frame axle 4 and is connected at its two ends with the links 5 provided at the two sides. In order to ensure pivoting of the backrest in dependence on the inclination of the seat a substantially non-extensible band or tape 8 is provided which is secured to the periphery of a disc 12 which is fixed relative to the horizontal frame axle 4. This band 8 extends approximately in accordance with the seat 2 to a deflection roller 10 which is mounted on the link 5 and which is disposed in the region of the transition from the seat 2 to the back rest 3. From this deflection roller 10 the band 8 is lead to a shaft—which is likewise rotatably mounted in the link 5, which is executed here as an angled link, with the band being fixedly connected with the periphery of this shaft, or with the periphery of a disc which is fixedly connected to this shaft. A support 14 for the backrest 3 is in turn fixedly connected with this shaft 13.

The shaft 13 is biased by means of a torsion spring or by means of a tension spring 11 in a direction which acts to pull the band 8.

When the seat 2 is brought against the force of the resetting springs 9 into a position in which it is more inclined a relative movement results between the link 5 and the band 8 such that the shaft 13 and thus the backrest 3 are pivoted in the clock-wise sense, i.e. the inclination of the backrest 3 increases.

The ratio of the inclination of the seat to the inclination of the backrest can be selected in the manner desired in any particular case by appropriate choice of the attachment points for the band 8.

It is of significance that the backrest 3 can also be pivoted rearwardly against the force of the tensioning spring 11 independently of the predetermined backrest inclination set in any particular case by the seat inclination.

This separate pivotability of the backrest 3 is also present if distinct positions are provided for the seat which are preferably selectable, for example by means of a locking pin system. The arrangement for lowering the front edge of the seat 2 in dependence on the inclination of the seat is of particular importance.

For this purpose the front edge of the seat 2 is supported by a cam or two TM armed lever 15 mounted at the frame side with the prevailing position and thus the vertical level of the cam or lever depending on the inclination of the link 5 or of the seat 2 connected to this link 5.

The two-armed lever 15 engages for example via a gear tooth arrangement with one end of the link 5 which has the consequence that an inclined position of the link in the sense of lowering of the rear part of the seat 2 leads to counter pivoting of the two-armed lever 15 in the opposite sense and thus also to lowering of the front edge of the seat 2. This coupled movement gives the user of the chair the impression that the seat has a pivot axis in front of the seat and in particular in the region of the backs of the knees. The lowering of the front region of the seat however also has a favourable effect with regard to a more uniform distribution of loads in the backward leaning positions.

This principle of lowering the front region of the seat can also be realized in seating furniture of different construction independent of the special layout of the transmission unit. It is always important that the elements which bring about the lowering of the front region of the seat can be arranged at the sides of the seat, thus taking up little space, and that the course or characteristic of the lowering movement which is desired in a particular case can be realized by choice of appropriate lever ratios.

The front region of a seat mounted in the manner of a free swinger can have a seat fitting to which one end of a short intermediate lever is pivotally connected, with the intermediate lever being formed as a double armed lever and cooperating at its other end with a support arm for the seat in such a way that the support level of the front region of the seat is changed in dependence or its inclination.

FIG. 2 shows the embodiment of FIG. 1 in a more specific representation.

From this it is clear that the transmission units arranged at both sides of the seat 2 can be made very compact and space saving.

The link 5 which supports the seat 2 is of angled shape and approximately follows the contour of the seat and the backrest. The two portions of the angled link 5 subtend an obtuse angle with one another. The longer limb is pivotally connected with the horizontal frame axle disposed in the front region of the seat. A shaft 13 is mounted in the end region of the upwardly directed limb and a support member 14 for the backrest 3 is fixedly connected with this shaft. Pivoting of the shaft leads to a corresponding change in the selected inclination of the backrest 3.

A ring disc 12 which is fixed to the frame is provided concentric to the frame axle 4, and the band 8 is secured to the outer periphery of the ring disc 12. This band 8 runs inside the angled link 5 to a deflection pulley 10 disposed in the corner region of this link and from there to the shaft 13 with which the band 8 is again fixedly connected. A tension spring 11 is preferably arranged in a recess of the upwardly directed part of the link 5 and is secured at one end to the link. 5 and at the other end to the periphery of the shaft 13 in such a way that it tries to bring about pivoting of the shaft 13 in the counter-clockwise direction, and thus also tensions the band or tape 8. This tension spring 11 can also serve as an assistor spring for a torsion spring provided in the shaft 13 itself. A tension spring is likewise accommodated in the limb of the link 5 which determines the inclination of the seat. This latter tension spring serves as a resetting spring and is attached to the frame above the pivot axle 4, it thus exerts a torque on the link 5 in the counter-clockwise sense. This spring can also be a type of assistor spring for a torsion bar which extends in correspondence with the pivot axle and is connected to the links 5 provided on both sides of the seat. The lever 15 which serves to lower the front region of the seat 2 is in engagement with an element which can be pivoted together with the link 5 and this lever 15 causes the support point for the front region of the seat 2 to be lowered on pivoting of the link 5 in the clock-wise sense. The extent of the lowering of the front region of the seat can be predetermined in desired manner by the choice of the transmission ratio of the mechanical transmission system.

FIG. 2 shows the stool in the so-called active position, in which the occupant is generally upright or leaning forwardly, for example at a desk so as to carry out some action or other. In this position the seat 2 extends approximately horizontally and the backrest 3 is pivoted forwardly to a notable degree. The angle of opening between the seat and the backrest, i.e. the included angle, is smaller than 90°.

The fact that the backrest 3 can be pivoted independently about the shaft 13 on exerting an appropriate pressure is also advantageous in this position. It can also be clearly seen that the transmission units arranged on both sides of the seat always automatically adapt to the course of the seat and the backrest so that the technical and functional elements recede as far as possible into the background so far as the specific shaping of the chair is concerned, i.e. place no constraints on the shaping of the chair.

FIG. 3 shows an advantageous detail of the functional chair of FIG. 2. The special feature of this variant lies in the fact that the deflection member 10 is constructed as an eccentric member. The non-extensible band 8 is led around this eccentric member. The eccentric member 10 has a reduced diameter over part of its periphery. The region of reduced diameter is preferably constructed as a flat 21. The deflection member 10 can be rotated by means of a selection lever.

FIG. 3 shows the chair in the active position in which the backrest is pronouncedly pivoted forwardly. This is achieved in that the deflection member 10 is pivoted in such a way that the band 8 contacts the flattened part 21 and thus has a reduced spacing relative to the axis of rotation of the deflection member 10. This has the consequence that the backrest can be pivoted forwardly as a result of the action of the spring 11, and optionally of a torsion spring extending in accordance with the backrest pivot.

Instead of the two illustrated adjustment positions several individual stages of adjustment can also be provided in order to provide the user with the greatest possible degree of individual adaptability.

FIG. 4 shows a functional chair in accordance with the invention with a frame 1 for a seat 2 and a backrest 3, with the frame 1 being carried by a column 7 with an associated star shaped roller pedestal.

A first two-armed lever 15 is mounted via a pivot axle 4 in the front region of a frame 1 which extends at an obtuse angle relative to the column 17. This first two-armed lever 15 is connected to the seat 2 via a pivot joint 20, and indeed in the region of the front end of this seat 2. The other arm of this first two-armed lever 15 is coupled with one arm of a second two-armed lever 7, in particular via a coupling axle 6 which is formed as a pin and slot connection.

This second two-armed lever 7 is also pivotally connected to the frame 1, and indeed in correspondence with the main pivot axle 22 which is preferably constructed as a torsion bar spring axle and biases the seat 2 and the backrest 3 into the basic position, as can be seen in FIG. 4A.

The second two-armed lever 7 includes, in addition to the already mentioned short lever arm which is coupled with the first two-armed lever 15, a lever arm which is long in comparison therewith and which is pivotally connected to the backrest 3 at a bearing 23. This lever arm is preferably constructed as an angled lever and extends in correspondence with the armrest of the chair.

The seat 2 and backrest 3 are connected together via a hinge 24.

In the same manner as in all the further embodiments that are described the mechanism which is explained and shown in side view is present at both sides of the seat and backrest 3.

The two two-armed levers 7, 15 control the kinematics of the chair with the possibilities of movement of the seat 2 and the backrest 3 being indicated by arrows and with the distance between the seat and the armrest being made clear by the letter A.

FIG. 5 shows the chair of FIG. 4 in the so-called relaxation position, i.e. in the position in which the seat 2 is lowered furthest and the backrest 3 is pivoted is far backwardly as possible. The changed position of the seat, of the backrest and of the armrest, result from the kinematics that are used and can be compared with the basic position which is indicated in chain dotted lines.

It can be seen that, as a result of the user of the chair leaning backwards the seat 2 has been lowered both in the front region and also in the rear region, with the degree of lowering being indicated by the number "1".

The lowering of the seat 2 is initiated by pivoting of the second double-armed lever 7 in the clockwise sense, with the first two-armed lever 15 being pivoted in the counter-clockwise sense and thereby lowering the front edge of the seat 2 on the one hand and moving the seat 2 forwardly at the same time as a result of the pivotal connection. This forward component in the movement of the seat 2 has in turn the consequence that the angle of opening between the seat 2 and the backrest 3 is made larger as a result of the rigid connection between the pivot hinges 22 and 23 and indeed, as the number "2" signifies, in the ratio 1:2.

The distance between the seat 2 and the armrest increases due to this relative movement between the seat 2 and the backrest 3, and indeed in the desired manner by a few centimeters. This is indicated by the statement "A+" in FIG. 5.

As a result of the kinematics that are used the seat 2 behaves during the transition from the basic position into its inclined position as if it were being moved about an ideal pivot axis 25.

It is evident that the layout of the arm of the second double-armed lever 7 at the backrest side can be chosen in different ways since it is only the rigid connection between the pivot joints 22 and 23 which is important. Thus the shape of the arm can be chosen in a manner which meets the particular requirements, with the layout of this lever arm so that it simultaneously forms an armrest being preferred.

FIG. 6 shows a variant of the chair of FIGS. 4 and 5 in which an adjustment of the backrest in the direction of the front edge of the seat is additionally possible.

The basic kinematics consisting of the two double armed levers 7 and 15 is unchanged, important however is the division of the backrest into a base part 3 and a support part 3'. The base part 3 is again movably connected with the seat 2, in particular via a pivot joint 24, while the support part 3' in this case represents the actual backrest associated with the user.

This support part 3' is pivotally mounted on a carrier lever 26 via a hinge 27, with the hinge point being disposed in the upper region of the backrest.

The carrier lever 26 is fixedly connected with a pivot axle or pivot roller 28 which is journalled on a base part 3. This bearing simultaneously forms the point of pivotal attachment for the second two-armed lever 7. The adjustment of the support part 3' takes place via a positioning mechanism which consists of a band 29 which partly engages around the pivot roller 28 and is coupled therewith in force transmitting manner. The band 29 is tensioned by a tension spring 30 and is guided via a deflection roller acting as a positioning member 31 to the pivot axle 22 where it is secured.

If the stool is in the basic position shown in FIG. 6 then the support part 3 will be held in the rearmost position and indeed via the band 29 against the action of the spring 30. This position of the stool can be termed the active decision-taking position.

FIG. 7 shows that the control member 31 has been displaced downwardly in comparison to its position in FIG. 6 which, having regard to the spring 30, is equivalent to lengthening of the band 29, i.e. the tensioned spring 30 has become shorter and the carrier lever 26 has been pivoted in the counter-clockwise sense. This pivoting of the carrier lever 26 corresponds to a displacement of the support part 3' in the direction towards the front edge of the seat. This makes for ideal back support on change of position, and in particular when the user, male or female, of the stool only sits on the front region of the seat 2, which is the case when typewriting. In this way an effective support of the lumbar region and of the spine is ensured, even in this critical seating position. The support part 3 participates in slight movements forwardly and rearwardly and, if required, a spring resetting force can be introduced for the basic position.

FIG. 8 shows the transition of the chair of FIGS. 6 and 7 into the relaxation position in which the seat 2 is lowered and the carrier lever 26 is moved back on lowering of the seat 2 through the already described control of the band 29, so that a comfortable relaxed position is achieved without an additional switch, i.e. automatically. This is a consequence of the fact that the band 29 is pivotally connected to the pivot axle 22 at a point away from its centre.

FIG. 9 shows a variant of the chair of FIGS. 6 to 8 with the carrier lever 26 extending downwardly from the pivot roller 28 and being connected with the seat side end region of the backrest support part 3' via a pivotal lever 32, which is controlled via a band positioning mechanism.

The band positioning mechanism is again formed by a steel band 29 which is eccentrically secured to the pivot axle 22 and is guided via an adjustable member 31 to the pivot roller 28 at the backrest side, and from the latter via a roller which is fixedly connected with the pivotal lever 32 to a tensioning spring 30. In contrast to the described embodiment of FIGS. 6 to 8 the carrier lever for the support part 3' accordingly extends downwardly and is moved via the tape positioning mechanism substantially in parallel, forwardly, towards the front edge of the seat, and back on pivoting of this carrier lever 26. FIG. 9 also indicates, by means of a vertical double arrow, that the stool can be provided with the customary vertical adjustment.

In order to achieve a transition from the basic position shown in FIG. 9 into the active position shown in FIG. 10 it is merely necessary to adjust the positioning member 31, which can be located so that it is comfortably reached on the vertical post of the armrest so that an extension of the band takes place related to the pivot roller 28. This extension of the band ensures that the spring 30 can contract further, and thus that the carrier arm 26 can be pivoted in the clockwise sense and the pivotal lever 32 in the counter-clockwise sense. This has the consequence that the backrest support part 3' moves forwardly, and the seat reaches the active position in which the support part 3' still extends substantially vertically, but has a substantially smaller distance from the front edge of the seat in comparison to the basic position.

During the transition into the relaxed position shown in FIG. 11 a lowering of the seat 2 takes place, in the same manner as already discussed in connection with FIG. 8, with simultaneous guiding back of the support part 3' into the rearward position. In doing this the movements which result from the double lever kinematics are superimposed on the movements brought about by the band positioning mechanism in advantageous manner, in such a way that ideal positions result without actuation of the positioning member 31.

FIG. 12 shows a functional stool constructed as a free swinger, the seat 2 and backrest 3 of which are carried by a frame 1 having a column 17 which is connected with a star pedestal 18 with rollers. The specific layout of the frame can however in principle take place in any desired manner.

The seat 2 and backrest 3 are pivotable relative to one another and can be connected together via a hinge 24. In the region of the front edge of the seat 2 the latter is pivotally connected with a lowering lever 15 which is pivotally mounted on an axle fixed relative to the frame. A carrier link 33 is also pivotable relative to this fixed frame axle and extends between this fixed frame axle and the backrest 3 to which it is pivotally connected at a pivot bearing 23. This link 33 can also be simultaneously constructed as an armrest.

A torsion bar 34 which is fixed at its centre extends coaxial to the fixed frame axle and the links 33 provided at both sides of the seat surface are fixedly connected with the ends of the torsion bar 34. The adjustment of the inclination of the seat 2 and of the backrest 3 accordingly takes place in each case against the resetting force of this torsion bar spring 34.

FIG. 13 shows the transition from the initial position shown in FIG. 12 into the approximately half lowered position. In this the angle between the seat 2 and the backrest 3 is enlarged on the one hand and the seat surface 2 is lowered in the region of its front edge on the other hand. This is a consequence of the fact that pivoting of the link 33 in the clock-wise sense results in pivoting of the lowering lever 15 via an intermediate transmission in the counter-clockwise sense with the seat 2 being moved forwardly—as indicated by the double arrow—and not only downwardly.

FIG. 14 shows the chair with the seat 2 fully lowered, with the original initial position also being indicated in broken lines. In this lowered position the lowering lever 15 is almost horizontal and the angle of opening between the seat 2 and the backrest 3 has adopted its maximum value.

FIG. 15 shows a preferred embodiment of the transmission 35 which ensures the oppositely directed movements of the link 33 and the lowering lever 15.

The axle fixed to the frame is constructed as a pipe 36 through which the torsion spring 34 extends, with the torsion spring 34 being rotationally fixedly connected at its ends with a bearing head part 19 which represents a component of the link 33.

A carrier sleeve 16 is rotatably mounted on the tube 36 spaced apart from the bearing head part 19 and is fixedly connected with the lowering lever 15, or formed in one piece therewith.

Blind bores 37 are formed in the carrier sleeve 16 and in the bearing head part 19 and substantially confront one another in the basic position of the seat. These blind bores 37 are located in each case on a circle coaxial with the tube 36.

A ring disc-like deflection member 38 is provided on the tube 36 between the carrier sleeve 16 and the bearing head part 19 and is fixedly connected with the tube 36, and thus with the frame. This deflection member 38 has openings 13 corresponding to the circularly distributed blind bores 37, with the diameter of these openings being greater than the diameter of the blind bores. The openings 39 are preferably of double V-shape in cross-section so that the rods 40 are guided at the centrally disposed position of the smallest cross-section, but can nevertheless carry out the required deflecting movements unhindered.

The rods 40 which extends through the openings 39 are preferably spring steel rods the ends of which engage in the blind bores 37 of the carrier sleeve 16 and of the bearing head part 19. In the basic position of the chair, i.e. with the non-lowered seat the bars 40 preferably in each case contact the base of the blind bores 37 so that an abutment or pressure point is obtained.

On transition from the basic position shown in FIG. 12 into the maximum lowered position shown in FIG. 14 a counter directed pivoting of the link 33 and the lowering lever 15 takes place —as shown in FIG. 16—because on pivoting the link 33 in the clock-wise sense the rods 40 pivot the lowering lever in the counter-clockwise sense via the deflection member 38 which is fixed relative to the frame. The transmission ratio can be influenced in accordance with the positioning of the deflection member 38.

With regard to the axle fixed relative to the frame an alternative embodiment it is shown in broken lines in FIG. 15. In this arrangement the axle fixed relative to the frame is formed by a tube 41 which engages over the carrier sleeve 16 and the bearing head part 19 and is fixedly connected with the disc-like deflection member 38. In this case no connection exists between the tube 36 and the deflection member 38. The tube 36 serves only to provide a rigid coupling of the links 33 provided on both sides of the seat.

The advantage of all these coaxial transmission arrangements lies above all in their simple and space saving construction which makes it possible to arrange all the components on the same axis.

FIG. 17 shows in a highly schematic manner one possibility of obtaining a weight dependent adjustment of the inclination of the seat 2. For this purpose a mechanism is necessary which makes it possible to increase the bias of the spring which carries the seat in dependence on the loading of the seat. A preferably multi arm lever 44, which may for example be constructed in parallelogram-like manner is pivotally connected to a column 17 and stands under the bias of a spring 42. The lever 44 carries the seat 2 via the horizontal frame axle. A non-extensible band 45 is secured to disc or roller members 43 at their periphery. The lower disc member 43 is fixed relative to the frame while the upper disc member is connected with the torsion spring which extends in correspondence with the frame axle.

If the lever 44 is pivoted downwardly due to a load on the seat then this leads to a rotation of the disc 43 and thus of the torsion spring in the direction of the indicated arrow, which has the consequence of increasing the bias of the torsion spring.

FIG. 18 shows a chair of the kind described with reference to FIGS. 4 and 5, and indeed shows both the basic position and the most reclined position. Both two-armed levers 7, 15 are executed as cranked levers and connected together via a pin and slot coupling. The pivotal connection of the first two-armed lever 15 to the seat 2 can take place in the illustrated manner or directly, and immediately at the front edge of the seat at the sides. The two arms of each of the two two-armed levers 7, 15 preferably include an angle with one another in the range from 120° to 150°.

A special feature of the chassis of functional seating furniture constructed in accordance with the invention lies in the fact that a surrounding support edge 46 is associated with each roller and indeed with the same outline diameter of the chassis. In this way it is possible to achieve a substantially improvement in safety against tipping irrespective of the particular position of the chair rollers, with the peripheral support edge moreover being able to take on the task of providing a soft abutment strip which protects the furniture.

The whole stool is preferably made so that it is capable of being broken down for despatch in order to ensure a package volume which is as low as possible for despatch purposes. The interfaces lie in this arrangement at the points chassis/column, column/frame-link and also frame/seat shell and these items are so constructed that they can be plugged together and connected together b a few simple hand actions, for which purpose bayonet or screw connections are provided.

Moreover this interface solution makes it possible to construct stools in accordance with the modular principle, since different stools can also be put together from different individual elements, which results in lower tied up capital when compared with the storing of completely assembled stools.

I claim:

1. Seating furniture, comprising:

a variably inclinable seat including front and rear portions and left and right sides;

a variably inclinable backrest including upper and lower ends;

means for connecting said rear portion of said seat to said backrest to permit relative movement therebetween;

a frame disposed beneath said seat;

axle means attached to said frame and disposed beneath said front portion of said seat, defining a transverse pivot axis;

first and second links, situated respectively adjacent said right and left sides of said seat, said links extending generally from said axle means to said backrest and said links being pivotable about said transverse pivot axis;

spring means positioned between said links and said frame for supporting said links in a cantilever manner extending rearwardly from said axle means, said spring means acting between said links and said frame such that said links are biased into a basic position relative to said frame, in which said seat is in its uppermost position;

backrest pivot means for pivotally connecting a rear end of each said link to said backrest;

first and second levers disposed beneath said seat respectively at the left and right sides thereof;

seat pivot means for pivotally connecting a first end portion of each said lever to said seat;

frame pivot means for pivotally connecting a second portion of said lever to said frame, said frame pivot means being connected to each said lever at a lever position spaced from said first end thereof; and means disposed between said links and said levers for transmitting movement of a front end of said links about said transverse pivot axis to said levers;

said means for transmitting causing a lowering of a front region of the seat on increasing inclination of the seat and corresponding change in inclination of said links.

2. Seating furniture in accordance with claim 1, wherein each said first and second lever is a two-armed lever having a first arm pivotally connected to said seat and a second arm connected to an end of a respective one of said links; and further including motion transmission means for connecting said second arm to said links, said motion transmission means forming a part of said transmitting means.

3. Seating furniture in accordance with claim 2, wherein each said first and second links is a further two-armed lever having first and second arms, wherein each said second arm of said further levers is connected by said backrest pivot means to said backrest;

said axle means being spaced apart from said frame pivot means; and said second arm of each said first and second lever points towards and is respectively coupled to said first arm of each said further lever.

4. Seating furniture in accordance with claim 3, wherein said backrest pivot means connects said links directly to said backrest.

5. Seating furniture in accordance with claim 3, wherein said first arm of each said further lever is shorter than said lever arm thereof.

6. Seating furniture in accordance with claim 5, wherein each said second arm of said further links is an armrest carrier.

7. Seating furniture in accordance with claim 3, wherein each said first two-armed lever is a cranked lever; and further including pin and slot motion transmission means for connecting each said second arm of said first two-armed levers to an associated first arm of said further levers, said motion transmission means forming part of said transmitting means.

8. Seating furniture in accordance with claim 7, wherein when said further two armed-levers are in said basic position, said pin and slot transmitting means is disposed substantially on a line projecting from said transverse pivot axis to said frame pivot means, said seat pivot means being, when said seat is in a minimum elevation position, disposed between said first two-armed levers and said seat, on said projecting line.

9. Seating furniture in accordance with claim 1, wherein said means for connecting said rear portion includes a pivot joint.

10. Seating furniture in accordance with claim 1, wherein said means for transmitting causes 11. Seating furniture in accordance with claim 1, including a transmission acting between said seat and said backrest, comprising:

a positioning member, coupled with said backrest, pivotably mounted on said links; and actuating means for pivoting said positioning member, said actuating means connected at a first end to said positioning member and connected at a second end to said frame in the region of but displaced relative to said transverse pivot axis said transmission forming part of said transmitting means.

12. Seating furniture in accordance with claim 11, wherein said actuating means includes a band.

13. Seating furniture in accordance with claim 11, wherein said actuating means includes a tension spring and a non-extensible band held in a tensioned state by said tension spring.

14. Seating furniture in accordance with claim 12, wherein said seat and backrest have a shape, and further including first and second bands respectively disposed on each side of said seat, each band substantially following the shape of said seat and said backrest.

15. Seating furniture in accordance with claim 13, wherein said axle means includes a fixed axle mounted on said frame; further including:

a deflection member; and a disc fixedly attached to said axle;

each said band having a first band end fixed to a periphery of said disc, and a second band end fixedly connected to a support for said backrest, each said band being guided between said ends over said deflection member.

16. Seating furniture in accordance with claim 15, wherein said backrest pivot means includes a shaft fixedly connected to said backrest;

said second band end being connected to said shaft.

17. Seating furniture in accordance with claim 16, wherein said second band end is connected to a disc fixed to said shaft.

18. Seating furniture in accordance with claim 15, wherein a said deflection member is mounted on each said link.

19. Seating furniture in accordance with claim 15, wherein each said deflection member is adjustable and eccentric shaped permitting change of an included angle between said seat and said backrest.

20. Seating furniture in accordance with claim 1, wherein said axle means includes:

a guide tube; and a torsion bar having a length, a middle and ends, situated within said guide tube, said ends connected to said links in a form locked and force transmitting manner;

said links being pivotably journalled on said ends of said guide tube.

21. Seating furniture in accordance with claim 20, wherein said middle of said torsion bar is secured in said guide tube.

22. Seating furniture in accordance with claim 20, further including:

carrier sleeves arranged on said guide tube, spaced apart from said links, defining a plurality of receiving bores in said sleeves; and a transmission, situated between each said carrier sleeve and adjacent link, including a plurality of rods and a deflecting member defining a plurality of openings;

said levers being fixedly connected to respective said carrier sleeves;

an end of each said link including a bearing head;

said deflecting member being rigidly attached to said guide tube and situated between said carrier sleeve and said bearing head;

each said rod extending through a said opening in said deflecting member;

a first end of each said rod engaging a said bore in said carrier sleeves, and a second end of each said rod engaging said bearing head;

said transmission situated between each said carrier sleeve and an adjacent link, for converting pivotal movement of each link in one direction into pivotal movement of said carrier sleeve in an opposite direction said transmission forming part of said transmitting means.

23. Seating furniture in accordance with claim 22, wherein said deflecting member includes a ring disc defining openings distributed around a periphery; said openings have a "double V" cross-section, a smallest diameter of said openings being approximately a diameter of said rods.

24. Seating furniture in accordance with claim 23, wherein said rods are spring steel.

25. Seating furniture in accordance with claim 22, wherein said receiving bores are formed as blind bores; and each said rod has a length permitting said rod ends to contact end surfaces of said receiving bores in said carrier sleeve and in said bearing head.

26. Seating furniture in accordance with claim 1, wherein said backrest includes a base part and a support part, and wherein said pivot means connect said links to said base part.

27. Seating furniture in accordance with claim 26, wherein said base part includes a carrier lever, and said support part is pivotally connected to said carrier lever;

and further including positioning means for pivoting said carrier lever to adjust said support part between a first position adjacent said base part with an inclination corresponding approximately to the inclination of said base part, and a second position spaced from the base part and displaced towards said front portion of said seat.

28. Seating furniture in accordance with claim 27, wherein said backrest pivot means includes a pivot roller forming a pivot axle, said carrier lever being secured to said pivot roller;

said positioning means including a band having a length, partly engaged around said pivot roller and coupled therewith for transmitting force and rotating said pivot roller;

further including a spring for tensioning said band and a positioning member for selectively changing the effective length of said band between said spring and said pivot roller.

29. Seating furniture in accordance with claim 28, wherein said band is secured in the region of said axle means;

said links including an angled lever arm, said positioning member being situated adjacent said angled lever arm;

each said band being guided around said positioning member, passing partially around said pivot roller, before being connected to said tension spring;

said tension spring being likewise secured to said angled arm;

said positioning member including a deflection roller, displaceable approximately in a vertical direction while changing said effective band length.

30. Seating furniture in accordance with claim 27, wherein said carrier lever extends downwardly from said pivot roller and is pivotally connected to said backrest support part adjacent said seat;

further including a second roller, fixedly attached to said pivot;

said band being guided around said pivot roller and, in an opposite sense, being guided around said second roller before being connected to said spring;

said spring being secured to said carrier lever and providing a tensioning and resetting force.

31. Seating furniture in accordance with claim 1, further including bias means for increasing the bias of said spring means in dependence on the weight of the occupant of said seat.

32. Seating furniture in accordance with claim 31, wherein:

said spring means includes a torsion spring disposed within said axle means;

said frame includes a pedestal and a pedestal lever, pivotally connected to said pedestal, said pedestal lever connecting said axle means to said pedestal;

further including a restraining spring for restraining pivotal movement of said pedestal lever relative to said pedestal; and a said non-extensible band extending from said pivot joint to said torsion spring to increase the bias thereof when said pedestal lever moves downwardly against the force of said restraining spring as a result of an occupant sitting on said seat.

33. Seating furniture, comprising:

a variably inclinable seat including front and rear portions and left and right sides;

a variably inclinable backrest including front and rear portions and left and right sides;

means for connecting said rear portion of said seat to said backrest to permit relative movement therebetween;

a frame disposed beneath said seat, including a horizontally disposed transverse axis;

first and second links, situated respectively at the left and right sides of said seat, each link including a front end portion and a rear end;

frame pivot means, situated at said front end portions of said links, for pivotally connecting said links to said frame for pivotal movement about said transverse axis;

means, situated at said rear ends of said links, for connecting said rear ends of said links to said backrest;

spring means positioned between said links and said frame for supporting said links in a cantilever manner extending rearwardly from said axle means, said spring means acting between said links and said frame such that said links are biased into a basic position relative to said frame, in which said seat is in its uppermost position;

lever means disposed generally at and beneath a front portion of said seat for pivotal movement about a horizontal axis, said lever means being pivotally connected at a first end portion to said front portion of said seat and adjacent a second portion to said frame; and means disposed between said links and said levers for transmitting movement of said links about said transverse axis to said lever means to produce lowering of said front portion of said seat on increasing inclination of said seat.

34. Seating furniture, comprising:

a variably inclinable seat including front and rear portions and left and right sides;

a backrest including upper and lower ends, said backrest variably inclinable as a function of seat inclination;

means for pivotally connecting said rear portion of said seat to said lower end of said backrest to permit relative movement therebetween;

a first pivot axle, attached to said frame beneath said front portion of said seat;

a second pivot axle, attached to said frame and spaced apart from said first pivot axle;

first and second two-armed levers, pivotally connected to said frame at said first pivot axle, disposed generally beneath said seat respectively at the left and right sides thereof;

a seat pivot joint for pivotally connecting a first arm of each first and second two-armed lever to said seat;

third and fourth levers, each having a short arm and a long arm adapted to serve as an armrest carrier, pivotally connected to said frame at said second pivot axle, said levers situated respectively adjacent said left and right sides of said seat;

an upper end of each said long arm of said third and fourth levers pivotally connected to said backrest;

slot and pins means for connecting each said short arm of said third and fourth lever with a second arm of each said first and second two-armed lever; and spring means acting between said third and fourth levers and said frame for biasing said third and fourth levers into a basic position relative to said frame, in which said seat is in its upper most position;

said slot and pin means being, when in said basic position, disposed substantially on a line projecting from said second pivot axle to said first pivot axle;

said seat pivot means being, when said seat is in a minimum elevation position, disposed on said projecting line;

whereby increasing inclination of said seat is transmitted to said levers causing said front edge of said seat to become lowered.

* * * * *

UNITED STATES PATENT AND TRADEMARK OFFICE

CERTIFICATE OF CORRECTION

PATENT NO. : 4,988,145

DATED : January 29, 1991

INVENTOR(S) : Hartmut S. Engel

It is certified that error appears in the above-identified patent and that said Letters Patent is hereby corrected as shown below:

Column 13, line 2 insert after "causes" --said first and second levers to be adjusted in an opposite sense to said links.--

Signed and Sealed this

First Day of September, 1992

*Attest:*

*Attesting Officer*

DOUGLAS B. COMER

*Acting Commissioner of Patents and Trademarks*